United States Patent [19]

Koerber

[11] Patent Number: 4,493,602

[45] Date of Patent: Jan. 15, 1985

[54] WHEELCHAIR LIFT APPARATUS

[76] Inventor: Charles F. Koerber, 8905 Mentor Ave., Mentor, Ohio 44060

[21] Appl. No.: 288,379

[22] Filed: Jul. 30, 1981

[51] Int. Cl.[3] ..... B66B 9/20

[52] U.S. Cl. ..... 414/541; 187/9 R; 187/24; 414/921

[58] Field of Search ..... 414/540–543, 414/545, 921, 662–665, 668, 669; 187/9 R, 9 E, 10, 24, 25, 8.61, 95; 280/289 WC

[56] References Cited

U.S. PATENT DOCUMENTS

| | | | |
|---|---|---|---|
| 3,468,401 | 9/1969 | Letz | 187/25 |
| 3,516,559 | 6/1970 | Walter | 414/541 |
| 3,537,554 | 11/1970 | Elmore et al. | 192/45 |
| 3,847,292 | 11/1974 | Williams et al. | 414/541 |
| 4,124,097 | 11/1978 | Hawks et al. | 187/9 R |
| 4,133,437 | 1/1979 | Gates | 414/541 |
| 4,281,744 | 8/1981 | Koerber | 187/9 R |

*Primary Examiner*—Robert B. Reeves
*Assistant Examiner*—Donald T. Hajec
*Attorney, Agent, or Firm*—Watts, Hoffmann, Fisher & Heinke Co.

[57] ABSTRACT

A wheelchair lift apparatus of rotary construction including a brake system for a carriage lift assembly adapted to receive a wheelchair for mounting in the door opening of a vehicle, such as a van or the like, for automatically lifting the wheelchair user from ground level into and out of the van while under the users complete control and without any need for the user to leave the wheelchair.

10 Claims, 10 Drawing Figures

WHEELCHAIR LIFT APPARATUS

TECHNICAL FIELD

The present invention relates generally to the field of apparatus for moving persons into and out of a vehicle and more specifically relates to an improved construction and arrangement for a rotary wheelchair lift apparatus adapted to receive a conventional type wheelchair for moving a user into and out of a vehicle, such as a van or the like, of the type which incorporates a side-door opening whereby the user can easily and quickly be moved from ground level by an initial vertical lifting movement and then by a rotary pivotal movement into the van via the side-door, and then being able to reverse the procedure with the user having full control of the lift apparatus while sitting in the wheelchair to obviate any requirement to leave the wheelchair at any time. The wheelchair lift apparatus of the present invention is especially suited to use by disabled persons confined to a wheelchair mode life-style such as paraplegics and other such disabled persons. The present invention relates to the rotary wheelchair lift apparatus disclosed in the co-pending application of Charles Koerber filed Mar. 8, 1979 pursuant to Ser. No. 18,640 now U.S. Pat. No. 4,281,744 issued Aug. 4, 1981. Other types of wheelchair lift apparatus are disclosed in U.S. Pat. Nos. 4,124,097, 4,133,437; and 3,516,559.

BACKGROUND ART

The present invention relates to the aforementioned type of wheelchair lift apparatus and which includes a new and novel brake system to provide a positive and safe braking action to the lift carriage upon vertical up and down movement of the carriage upon actuation of a threaded drive screw pursuant to automatic control by the user. Also, the invention incorporates a new and improved drive mechanism for automatically pivoting the carriage about a vertical axis with a generally horizontal plane for movement into and out of the side door of a van or the like.

Heretofore, such rotary wheelchair lift apparatus have been available but have not incorporated a braking system to insure a positive and safe braking action on the lift carriage during operation by the user. It has been recognized that such braking system is important to provide a fail-safe and reliable system, particularly in situations where accidents might result by reason of drive belt breakage, motor failure, or the like such as caused by excessive loading and/or prolonged wear.

DISCLOSURE OF THE INVENTION

Accordingly, the present invention provides a new and novel braking system which is operably associated with the belt drive for the screw which insures a positive and reliable braking action with little or no drift of the lift carriage upon sudden stopping even under heavy load (i.e., 1,800 lbs.) conditions. The braking system of the invention incorporates a one-way clutching action which allows upward lifting movement of the carriage but which applies an automatic braking action by control of the user. The invention incorporates an extensible cable control for actuating the braking system by the user.

In the invention, there is also provided a new and improved drive mechanism for automatically pivoting the lift carriage through 90° about a vertical axis for swinging the carriage into and out of the side door, for example of a van or the like. The drive mechanism includes a drive screw constructed and arranged for automatically pivoting the wheelchair lift 90° in either direction upon actuation of the control cable by the user.

Other and further advantages and objects of the invention will become apparent as the following description proceeds taken in conjunction with the drawings and the claims appended hereto.

BEST MODE FOR CARRYING OUT THE INVENTION

Figure 1:
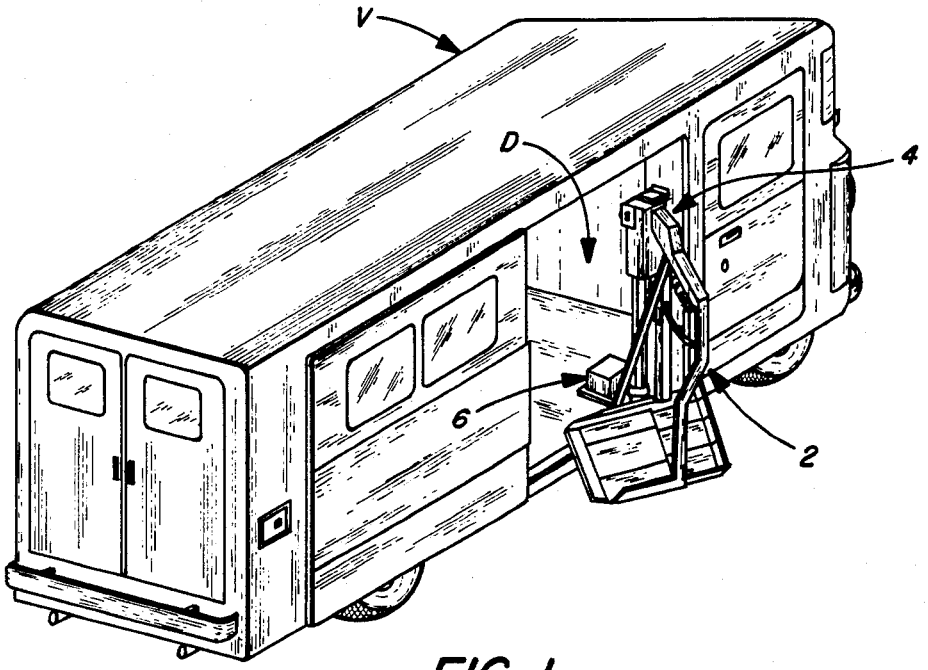
FIG. 1 is a generally perspective view illustrating the wheelchair lift apparatus of the invention for pivotal movement into and out of the side door of a van-type vehicle.

Referring now again to the drawings and particularly to FIG. 1 thereof, there is illustrated a wheelchair lift apparatus, designated generally at 2, of the present invention. As shown, the apparatus is installed for use with a conventional vehicle V, such as a recreational van or the like. As shown, the lift apparatus is disposed within the side-door opening D of the vehicle adapted for rotational movement about a general vertical axis to provide ingress and egress to the user, such as an invalid. Specifically, this pivotal movement about the vertical axis is illustrated in FIG. 1 which also illustrates a lower drive mechanism, as at 6, for the wheelchair lift apparatus.

Figure 3:
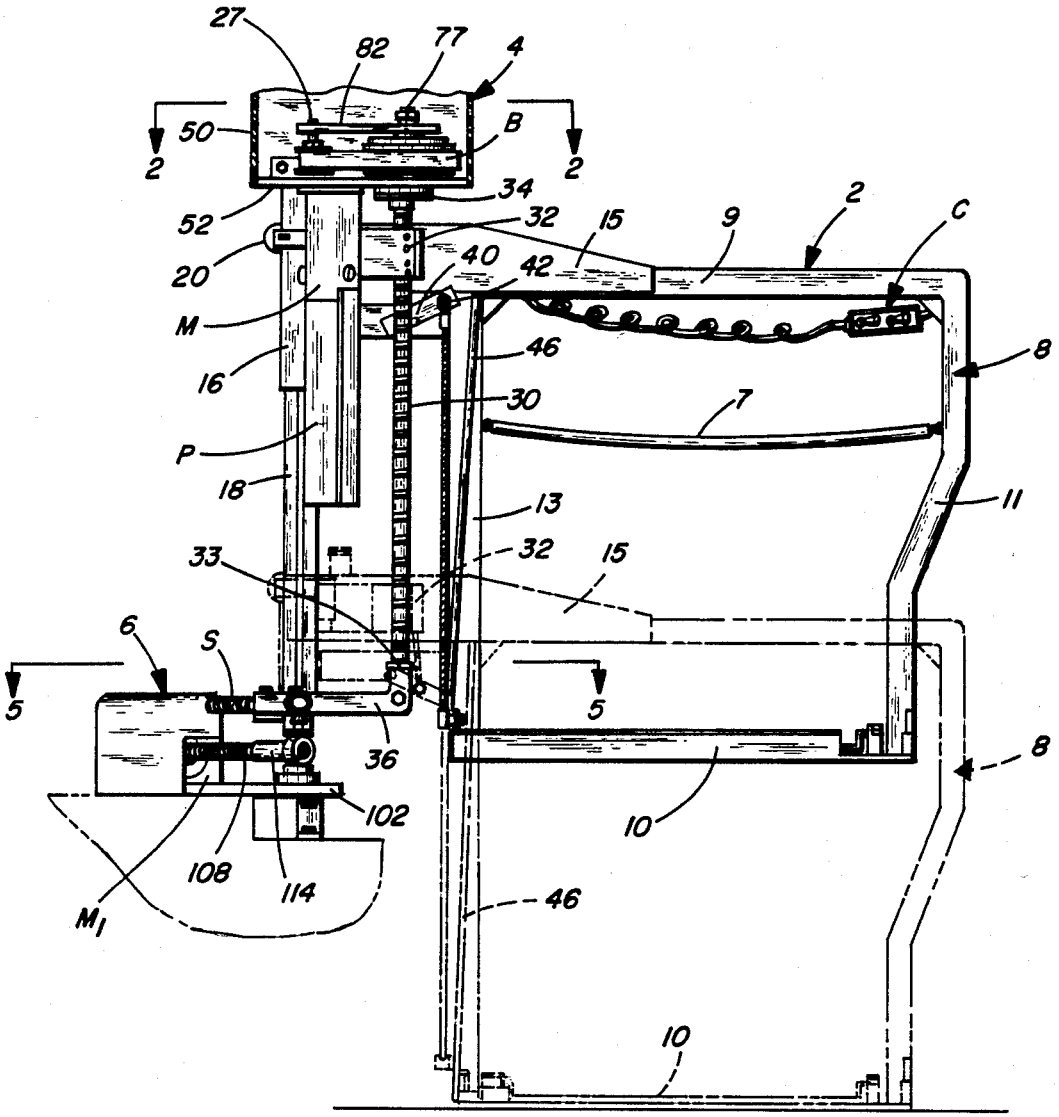
FIG. 3 is a fragmentary, end elevation view illustrating the wheelchair lift apparatus of the present invention.

As best illustrated in FIG. 3, the lift apparatus 2 incorporates a lift frame, designated generally at 8, which is of a generally inverted U-shaped frame configuration 8 defined by a cross-piece 9 and a pair of integral downwardly extending arms 11 and 13 which mount a lift platform 10. This lift platform is generally identical to that described in applicant's aforementioned co-pending application Ser. No. 06/018,640. In this embodiment, however, there is also provided a flexible safety belt or strap 7 which prevents the user from inadvertently rolling forward on the wheelchair from off the platform 10. The frame 8 may include a housing section 15 for mounting operating controls. However, in this embodiment the controls, designated at C, are provided from a flexible control cord, as best illustrated in FIG. 3.

In the embodiment illustrated, the lift assembly includes a column support mechanism 18 in the form of a vertically disposed column member which is mounted on a base plate 102 which, in turn, may be detachably mounted on the floor of the vehicle. As will be described, the column member 18 is driven for pivotal movement about a vertical axis via a lower drive mechanism 6 mounted on the base plate 102.

Figure 2:
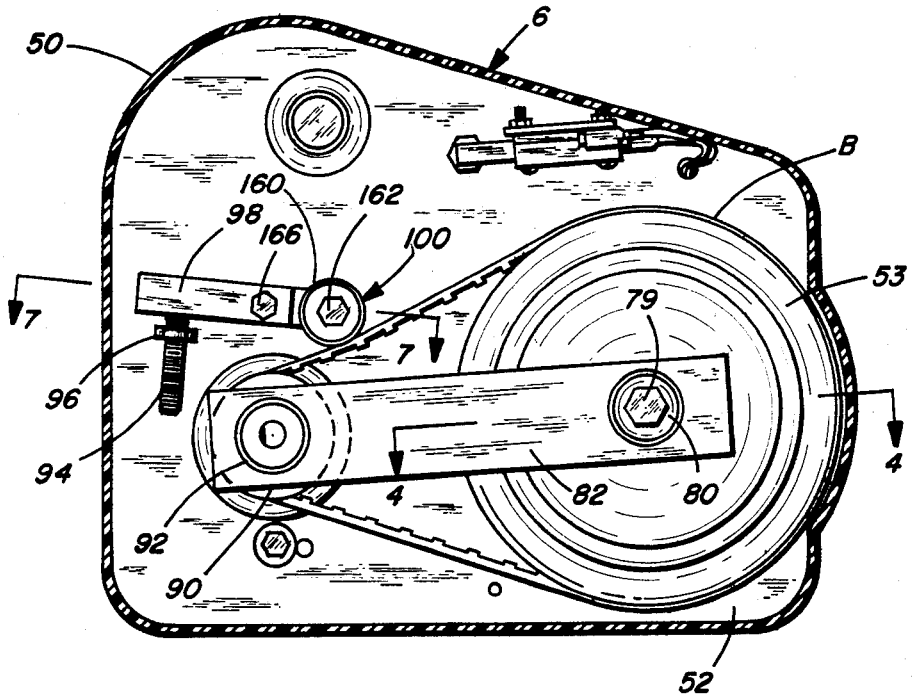
FIG. 2 is a horizontal section view, on an enlarged scale, taken along the line 2—2 of FIG. 3.
Figure 4:
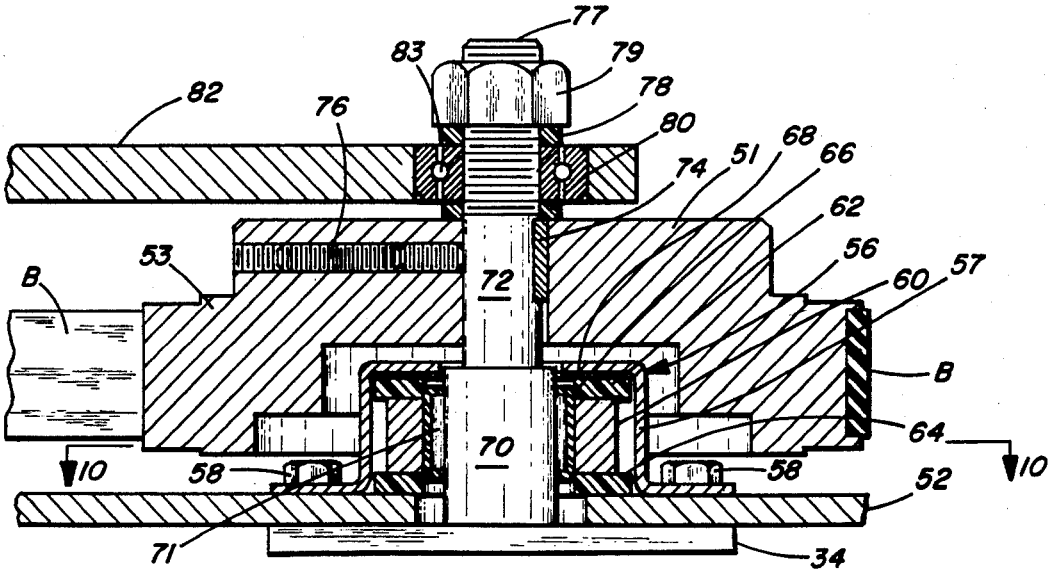
FIG. 4 is a fragmentary, horizontal section view taken along the line 4—4 of FIG. 2 on an enlarged scale.
Figure 5:
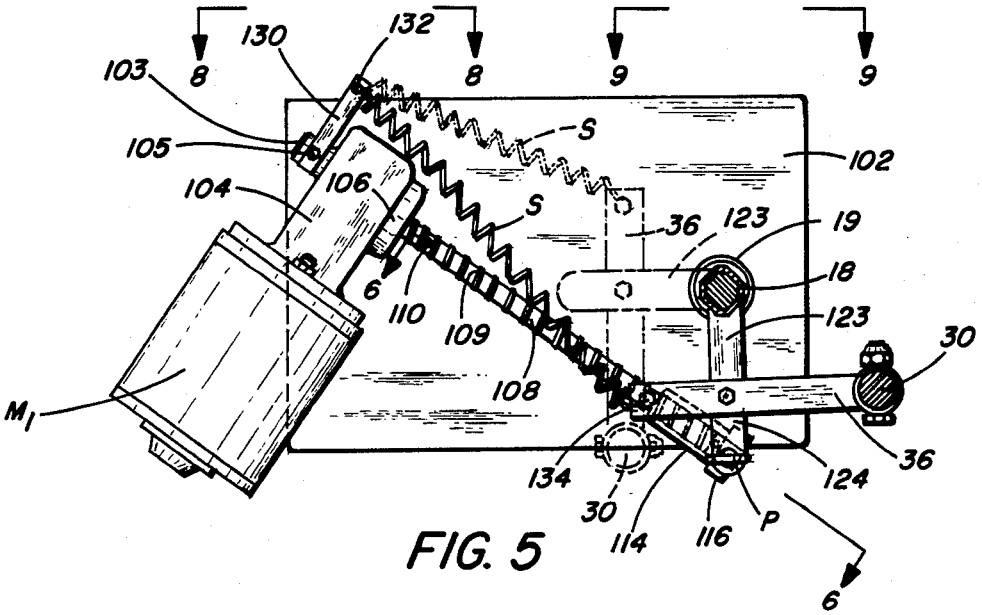
FIG. 5 is a horizontal section view taken along the line 5—5 of FIG. 3, on an enlarged scale, with parts broken away for the purpose of clarity.

As best illustrated in FIGS. 2, 3 and 4, the lift apparatus includes an upper drive assembly, designated generally at 4, for moving the lift apparatus vertically on the column support mechanism 18. As shown, this upper drive assembly includes an electric drive motor M fixedly mounted on a top support plate 52 which is fixedly attached to the upper end of the column member 18. The drive motor M is operably connected to a vertical drive screw 30 via a drive pulley belt B which is driven by a pair of drive pulleys 53 and 90, as best illustrated in FIG. 2. The drive screw 30 is mounted at one end to an upper bracket 32 which is fixedly attached to the roller assembly 16. The lower end of the drive screw 30 is mounted for rotation within a Teflon bearing, as at 33, which, in turn, is attached to a bracket member 36 pivotally attached to the drive mechanism 6, as will be described hereinafter. As best seen in FIG. 3, the upper bracket 32 is illustrated in solid line in the full vertically oriented "up" position and in broken line in the full vertically oriented "down" position.

Now in accordance with the invention, the upper drive mechanism 4, as best illustrated in FIGS. 2 and 4, includes the driven pulley 53 which is mounted for rotation with a shaft 70 which is fixedly attached via a coupler 34 to the drive screw 30 (FIG. 3) for rotating the screw upon actuation of motor M. The shaft 70 has an elongated reduced diameter section 72 which extends vertically upwardly (FIG. 4) to a threaded end 77 which is locked via a threaded nut 79. Disposed between the nut 79 and the confronting upper surface of the integral hub portion 51 of the pulley is a plastic (Teflon) bushing 78. A stabilizing cross-bar 82 connects the upper end of the column support mechanism 18 (FIG. 3) with the upper end of the drive screw 30 via the drive shaft 70. That is, drive screw 30 is operably connected via the coupling, designated generally at 34, to the drive shaft 70. Accordingly, upon actuation of the drive motor M the drive pulley 90 is rotated which in turn, drives the pulley belt B which rotates the driven pulley 53 for rotating the drive screw 30 about its vertical axis for raising and lowering the lift frame 8 which is supported for vertical upward and downward movement on the support column member 8 via the roller mechanism 16. As illustrated, the coupler 34 is detachably connected to the plate 52 (FIG. 4) by means of bolts 58 so that there is provided a detachable connection between the drive screw 30 and the drive mechanism 4 to facilitate removal thereof.

The cross-bar 82 has roller bearings at the opposite ends, or at 80 and 92, to enable rotation of the shaft portion 72 and drive shaft 27. The bearings are of an identical construction each having a roller bearing arrangement 83 (FIG. 4). The shaft portion 72 is locked to the hub portion 51 of the pulley 53 by a set screw 76 in conjunction with a key 74 disposed between the shaft portion 72 and the hub portion 51.

Now in the invention, there is provided a new and novel braking system associated with the upper drive mechanism 4 which provides a fail-safe stop should there be any failure, such as by breakage of the pulley belt. It will be understood, however, that the drive motor M also has a built-in break mechanism (not shown) should the drive pulley belt break for any reason. Accordingly, in the invention there is provided a new and novel back up brake system that adds a further fail-safe stop should such application be required.

Now in the invention, there is operatively associated with the driven pulley member 53 a one-way clutch mechanism which automatically provides a braking action on the drive screw 30 should the drive belt B fail. This clutch relates to an overrunning clutch of the type wherein rollers are positioned between a cylindrical race surface and a cam surface and wherein a cage is provided for retaining the rollers in alignment with the cam surfaces and in spring-wedging engagement therewith. The cage is a finger-type cage and consists simply of an end ring having a plurality of circumferentially spaced, axially extending fingers. This cage may be molded of a plastic material and the fingers are shaped apart to define pockets therebetween and incorporate a stop means for engagement with a clutch member to position the cage in a position wherein each finger is resiliently deflected by the associated roller when the roller is in operative engagement with its associated cam surface so that the normally straight fingers of the cage function as spring elements in the assembled clutch. The specific structure and function of such clutch is disclosed in U.S. Pat. No. 3,537,554 assigned to the Torrington Company and is incorporated herein by reference.

As applied to the present invention, the one-way clutch transmits torque between the drive shaft 30 and the base plate 52 in the braking direction and allows free overrun in the opposite direction. That is, the drive screw 30 can be normally driven upwardly or downwardly via the drive belt B upon actuation of the electric motor M. However, in the event of belt failure or should the primary brake within the electric motor become inoperative for any reason, then rotation of the drive screw in the opposite, (i.e., downward direction) automatically actuates the lock mode of the one-way clutch which is opposite to that of the overrun mode. In this case, the rollers, assisted by the leaf-type springs, become wedged between the locking cam ramps and the drive screw 30 to transmit torque between the two members and hence, lock the drive screw against further rotation to prevent inadvertent dropping of the lift support frame 8 during normal usage thereof.

Figure 10:
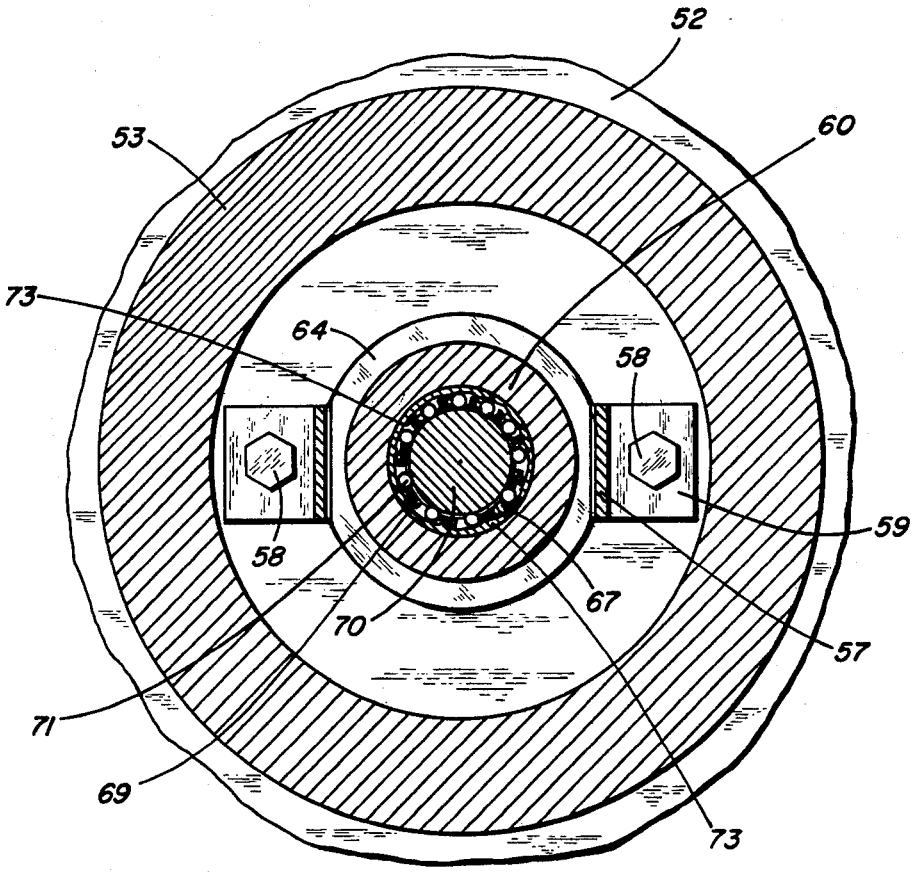
FIG. 10 is a fragmentary, on an enlarged side view taken along line 10—10 of FIG. 4.

Referring now specifically to FIGS. 4 and 10 of the drawings, it will be seen that the one-way clutch, designated generally at 56, includes an inverted U-shaped bracket member 57 that is attached via the bolts 58 to the base plate 52. The bracket member 57 mounts the interior of the one-way clutch which, in the invention, includes an outer cylindrical bearing collar 60 which is sandwiched in clamping relation between a pair of circular friction discs 62 and 64. Discs 62 and 64 are preferably made from a compressed cardboard or paper material so as to provide a frictional holding engagement with the collar 60. A resilient spring washer 66 is disposed around the shaft 70 and between the upper most disc 62 and a confronting interior surface 68 of the bracket 57 for resiliently biasing the discs 62 and 64 downwardly for holding the collar 60 against rotation relative to the base plate 52. Now in the invention, the one-way clutch mechanism, designated generally at 56, is of the aforementioned Torrington type as illustrated in the U.S. Pat. No. 3,537,554 and includes a cage 67 having a plurality of circumferentially spaced, axially extending fingers 69 which are adapted to be resiliently deflected by associated elongated pin rollers 71 which are disposed in engagement within associated cam surfaces 73 which coact to urge the rollers 71 radially outwardly into engagement with the confronting exterior surface of the drive shaft 70 in the locking mode thereof. That is, should the shaft rotate in the opposite direction so as to move downwardly carrying with it the lift support frame 8.

Prior to positioning of the shaft 70 within the clutch assembly, the rollers 71 are free to move radially inwardly at any distance, as permitted by the cam surfaces 73. At this time, the fingers 69 may be straight or very slightly bent. However, when the shaft 70 is positioned within the collar member 60, the shaft 70 will force the rollers 71 radially outwardly. Since the rollers engage the cam surfaces when forced outwardly and due to the slope of the cam surfaces, the rollers are forced in a clockwise direction, depending on the fingers and occurs at the time the shaft 70 is positioned.

Referring in particular to FIGS. 3 and 4, the drive mechanism operates as follows. When the pulley 53 is rotated in a direction for raising the lift, the shaft 72 (which is attached to the drive screw 30) freely rotates within the one-way clutch 56. The collar 60 remains stationary as the shaft 70 rotates. When the rotation of the pulley 53 is reversed, the one-way clutch clamps (via the rollers 71) the shaft 70 so that rotation of the shaft 70 causes the collar 60 to frictionally rotate between the friction discs 62, 64. Thus, the one-way clutch arrangement disclosed allows unimpeded rotation of the shaft 70 (and, hence, drive screw 30) when rotated in the lift raising direction and frictionally resists unimpeded rotation when the shaft 70 is rotated in the lift lowering direction.

As is well known, drive screw arrangements normally have self-locking characteristics. The weight of a wheel chair in the lift, however, will produce some "drift" or, gradual rotation of the drive screw if the shaft 70 and/or drive motor M is free to rotate. The frictional engagement provided by the collar 60 and the friction discs 62, 64 add sufficient resistance to the drive mechanism to prevent the weight of a loaded lift from producing gradual rotation in the drive screw in the lowering direction. Since the one-way clutch and friction arrangement is disposed between the pulley 53 and the drive shaft 70, the frictional brake will operate to inhibit downward movement of the lift should a failure occur in either the drive belt B or the drive motor M.

Figure 7:
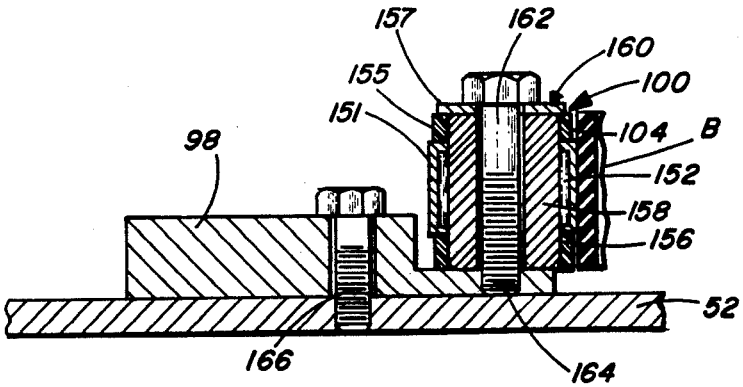
FIG. 7 is a fragmentary, horizontal section view taken along the line 7—7 of FIG. 2 on an enlarged scale.
Figure 8:
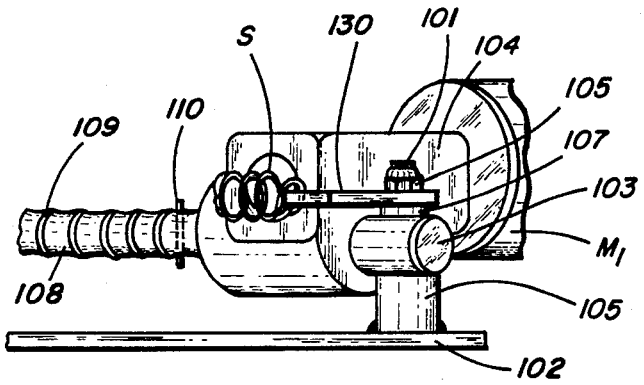
FIG. 8 is a fragmentary, side elevation view looking in the direction of the line 8—8 of FIG. 5.

As best illustrated in FIG. 7, a belt tensioning and brake mechanism, designated generally at 100, is operably associated with the drive belt, as illustrated in FIG. 2. As shown, the mechanism 100 includes a support block member 98 mounted on the base plate 52 for detachable connection via a threaded bolt, as at 166. From the member 98 extends another Torrington one-way clutch mechanism 160 detachably mounted via an elongated threaded bolt 162. The member 160 includes an interior elongated pin-roller assembly 152 disposed within a cage 151 that operably coacts with an inner cylindrical bearing collar 158 mounted between oppositely disposed plastic bushings 155 and 156. The collar 158 acts as a bearing and is held against rotation by means of a washer 157 secured under the headed bolt 162. By this arrangement, the collar 158 frictionally coacts with the confronting outer surface of the belt B for maintaining a predetermined tension on the same and also to provide a locking engagement should the belt for any reason be caused to rotate in the opposite direction. It is seen that the device provides a one-way clutch which provides a braking and tension action on the belt. Here, the rollers radially engage the collar 158 upon engagement of the belt B with the collar 158 in the lock mode of rotation, i.e., when the belt rotates in its non-drive mode. As best seen in FIG. 2, the support 98 may be selectively pivotally adjusted about the bolt 162 by means of a threaded nut 96 threadedly mounted on a threaded bolt 94 which is fixedly attached (i.e., welded) to the plate 52. Accordingly, by this arrangement threading of the nut 96 operably maintains the desired tension of the collar member 158 into frictional engagement with the belt.

Figure 6:
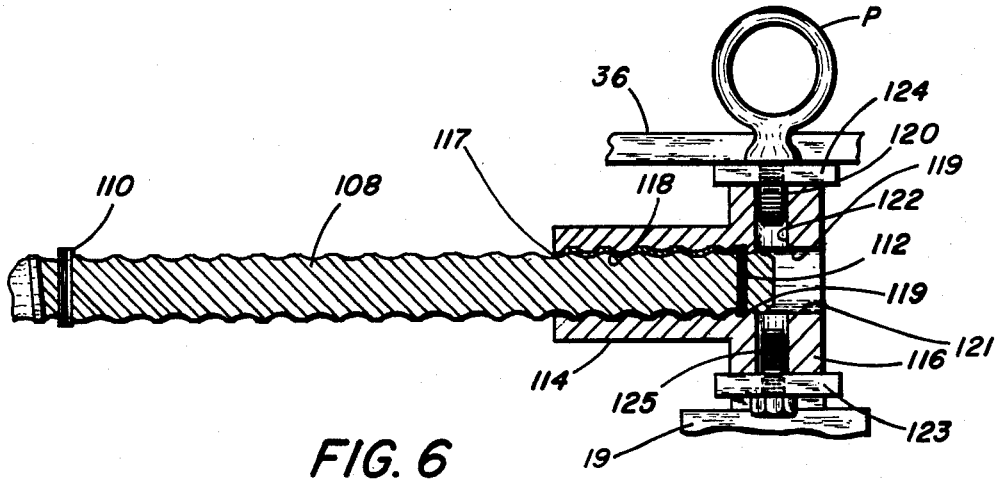
FIG. 6 is a fragmentary, horizontal section view taken along the line 6—6 of FIG. 5 on an enlarged scale.
Figure 9:
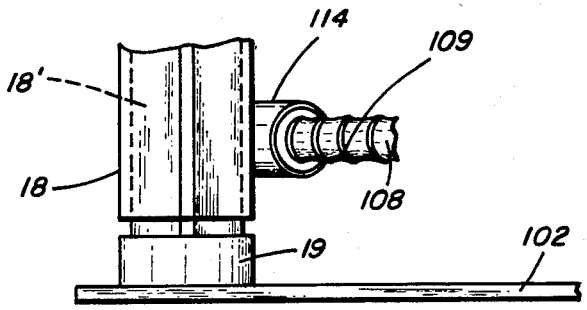
FIG. 9 is a fragmentary, side elevation view looking in the direction of the line 9—9 of FIG. 5.

Now referring to FIGS. 5, 6, 8 and 9, there is more specifically illustrated the lower drive mechanism 6 for pivoting the support column 18 and hence, the wheelchair lift frame 8 in a horizontal plane inwardly and outwardly through the side door D of the vehicle. As shown, this mechanism includes an electric drive motor M', pivotally mounted on the base plate 102. The motor includes an elongated drive gear section 104 having a drive bearing collar 106 for rotatably driving an elongated drive screw 108. The drive screw 108 has a helical drive thread 109 which is journaled at one end within the helical collar 106 at the other end within a helical threaded journal member 114. The drive screw 108 has a vertically extending locking pin 110 at one end and another vertically extending locking pin 112 at the opposite end. As best seen in FIG. 6, the locking pin 110 has a slightly greater length than locking pin 112 for lockably controlling drive movement of the drive screw 108 upon actuation of the drive motor M'. The drive screw 108 is fixedly attached within the gear section 104 so as to be rotated freely within the journal member 114 which is pivotally mounted via an integral hub 116 which, in turn, is mounted on a bell crank arm 123. The arm 123 is fixedly attached the support column 18 (FIG. 5) which is mounted for rotation about a vertical axis within a journal member 19, as illustrated in FIG. 9. The arm 123 is detachably connected to the hub 116 by means of a threaded bolt 125. The opposite end of the hub 116 is detachably connected to a support arm 124 which is welded to the suport bracket 36 (FIGS. 3 and 5) which, in turn, rotatably mounts the drive screw 30, as aforesaid. The arm 124 is detachably mounted to the hub 116 by means of a threaded lock pin P which has a threaded end 120 threadably received through the arm 124 and into an aperture 122 providing the hub, as illustrated in FIG. 6. By this arrangement, the support bracket 36 mounting the drive screw 30 (FIG. 3) can be locked in place by merely unscrewing the lock pin P so that the drive motor M', and drive screw assembly can be easily detached for maintenance and/or replacement.

The free end of the bracket member 36 is detachably connected, as at 134, to a spring S which is detachably connected at its other end, as at 132, to a bracket arm 130 which is fixedly attached, at 106, to an integral boss 103 which, in turn, is pivotally mounted on a cylindrical support column 105. The arm 130 rests on a plastic bushing 107 (FIG. 8) and is secured on the boss 103 by means of a threaded nut 101. By this arrangement, the electric motor M', and gear box section 104 mounting the drive screw 108 are mounted, as a unit, for pivotal movement in a horizontal plane about the pivot point 105. The spring S maintains a constant biasing compression for pivoting the bracket 36 mounting the support column 18 and drive screw 30 for pivotal movement, as a unit, about the pivot connection 19 defined by the vertical central axis of a support stub member 18' which is rotatably supported within the journal member 19. The stub 18' fits within the end of the hollow support column 18 for rotatably mounting the same on the face plate 102.

In the invention, the drive screw 108 is disposed for rotation within the journal 114 by means of a elongated cylindrical sleeve 118 which has an interior helically configuration to form to that of the helical thread 109 on the drive screw 108. The sleeve 118 is rotatably attached within the journal 114 and the journal, in turn, is fixedly attached to the support bracket 36 so that upon rotation of the drive screw 108 the bracket member 36 which mounts the support column 18 and drive screw 30 swings upwardly and outwardly about the pivot point 19. Accordingly, the drive screw 108 being fixed for driven rotation within the gear section 104 rotates through the internally helically formed journal 114 via the helical sleeve 118. The sleeve 118 is mounted for free rotation within a bore 117 which extends through the journal member 114 since the bore 117 has a helical configuration to accommodate the configuration of the helical sleeve 118. Now as the drive screw 108 is rotated, it moves axially outwardly through the journal member 114 which pivots the bracket member 36 mounting the support column 18 and the drive screw 30 for pivotal movement, as a unit, about the pivot point 19, as aforesaid. As this movement continues, the locking pin 112 is brought into engagement with a stop 121 provided on the sleeve 118. The sleeve 118 then becomes freely rotatable (i.e., slips) within the journal member 114 to stop any further pivotal movement in an outward direction. This indicates that the wheelchair lift has been swung outwardly to a point substantially perpendicular to the vehicle to be in a position to receive the user on a wheelchair (not shown). Accordingly, upon rotation of the drive screw 108 in the opposite direction, the movement continues which pivots the bracket member 36 mounting support column 18 and drive screw 30 in an inward direction for delivery of the user into the side door D of the vehicle. To complete this movement, the other stop pin 112 is brought into engagement with another stop 117 on the sleeve 118 to again cause the sleeve 118 to rotate within the journal 114 so that the drive screw 108 and sleeve 118 freely rotate within the journal 114 thereby stopping any further pivotal movement about the pivot point 19, as aforesaid. During this operation, the spring S maintains a constant resilient compression on the bracket member 36 to provide a positive pivotal rotation of the bracket member 36 about the pivot point 19, as illustrated in broken lines in FIG. 5. Accordingly, in FIG. 5 it will be seen that the bracket member has been pivoted through an angle of approximately 90° which enables the wheelchair lift apparatus including the support platform 10 to be disposed interiorly within the vehicle, as desired.

I claim:

1. The wheelchair lift apparatus of the type for wheeling a disabled person into and out of a vehicle such as a van of the like comprising a column support structure adapted to be fixedly mounted within said vehicle, a wheelchair lift structure mounted for vertical up and down movement on said column support structure and for pivotal movement on said column support structure in a generally horizontal plane about a vertical axis, first drive screw means mounted on said column support structure for raising and lowering said wheelchair lift structure in a vertical direction, first motor means mounted on said support structure for operably driving said first drive screw means for raising and lowering said wheelchair lift structure in said vertical direction; second motor drive means mounted adjacent the bottom of said support structure for pivoting said wheelchair lift structure about the vertical axis of said support column structure in a generally horizontal plane, one-way brake means operably associated with said first motor means and with said first drive screw means for providing an automatic braking action on said drive screw means to prevent vertical downward dropping movement of said wheelchair lift structure upon actuation thereof, a second drive screw means operably connected to said second motor drive means and said support column structure for pivoting said support column structure about a vertical axis in a general horizontal plane and through an angle of approximately 90° into and out of said vehicle upon actuation of said second motor drive means, said second drive screw means is drivingly connected at one end to said second motor drive means and is journalled at its opposite end for rotation within a journal means disposed on said support column structure, and said journal means including a slip mechanism disposed for operable coaction with said second drive screw means for automatically controlling horizontal inward and outward pivotal movement of said wheelchair lift structure about the vertical axis of said support column structure.

2. A wheelchair lift apparatus in accordance with claim 1, wherein said first motor drive means includes a pulley arrangement operably connected between said support column structure and said first drive screw means, and said one-way brake means operably connected between said pulley means and said drive screw means.

3. A wheelchair lift apparatus in accordance with claim 2, wherein said pulley arrangement includes a drive pulley operable connected to said first motor means and a driven pulley operably connected to said first drive screw means with a pulley belt operably connecting said drive and driven pulleys, and a one-way belt tensioning means disposed for maintaining a predetermined tension on said belt and for imparting a braking action on said belt when driven in an opposite direction.

4. A wheelchair lift apparatus in accordance with claim 3, wherein said driven pulley means includes a one-way clutch mechanism operably associated with said first drive screw means to allow free-rotation of said drive screw means in one direction but adapted to automatically lock said drive screw means against rotation in the opposite direction.

5. A wheelchair lift apparatus in accordance with claim 4, wherein said clutch mechanism is fixedly connected to said driven pulley means for free-rotation with said driven pulley means relative to said drive screw means.

6. A wheelchair lift apparatus in accordance with claim 5, wherein said support column structure is pivoted for pivotal rotation about a vertical axis on a support bracket member detachably connected to a floor portion interiorly of said vehicle, and said support column structure being resiliently biased in a direction toward said second drive motor means.

7. A wheelchair lift apparatus in accordance with claim 1, wherein said slip mechanism includes an elongated helical sleeve member fixedly mounted within said journal means, said sleeve member being helically formed to accommodate rotational movement of said second drive screw means axially therein, said sleeve member including abutment means at the opposed ends thereof adapted for coacting engagement with aligned stop means fixedly mounted on said second drive screw means to enable slipping rotation of said sleeve member in said journal means so as to stop pivotal movement of said wheelchair lift structure about the vertical axis of said column support structure in the full loading and unloading positions of said wheelchair lift apparatus.

8. A wheelchair lift apparatus in accordance with claim 7, including spring means operably connected between said second drive motor means and said support column structure for resiliently biasing said support column structure in a direction toward said second motor drive means.

9. A wheelchair lift apparatus in accordance with claim 7, wherein said sleeve member includes abutment means at each of the opposed ends thereof, said abutment means adapted for coacting engagement with integral pin-like stop elements extending from adjacent opposed ends of said drive screw means adapted for abutting engagement with said abutment means for causing rotational movement of said sleeve member in said journal member in respect to said drive screw means for controlling pivotal movement of said support column structure during actuation of said second drive motor means.

10. A wheelchair lift apparatus in accordance with claim 1, including a support bracket member adapted for detachably mounting on a floor portion interiorly of said vehicle, said support column structure including an elongated support column member, said column member being mounted on a link-arm means pivotally mounted about a vertical axis on said support bracket member, said first drive screw means including an elongated drive screw member mounted on said link-arm means for rotation in a generally horizontal plane about the vertical axis of said column member so that said column and drive screw members rotate, as a unit, in a horizontal plane about the vertical axis of said column member, and said link-arm means being fixedly connected to said journal means for pivotal movement of said link-arm means about said vertical axis upon rotation of said second drive screw means upon actuation of said second motor drive means.

* * * * *